US005938077A

United States Patent [19]

Erb

[11] Patent Number: 5,938,077

[45] Date of Patent: Aug. 17, 1999

[54] REFRIGERATED CABINET FOR DISPENSING LIQUID FOODSTUFFS

[75] Inventor: Rene Erb, Phalsbourg, France

[73] Assignee: Vitop, Schalbach, France

[21] Appl. No.: 08/803,746

[22] Filed: Feb. 21, 1997

[30] Foreign Application Priority Data

Feb. 21, 1996 [FR] France ..... 96 02302

[51] Int. Cl.[6] ..... B67D 5/22

[52] U.S. Cl. ..... 222/41; 222/41; 222/146.6; 222/184; 222/509

[58] Field of Search ..... 222/41, 146.6, 222/183, 184, 185.1, 505, 509

[56] References Cited

U.S. PATENT DOCUMENTS

| | | | |
|---|---|---|---|
| 4,505,409 | 3/1985 | Armstrong | 222/509 |
| 4,549,675 | 10/1985 | Austin | 222/505 |
| 4,722,463 | 2/1988 | Anderson | 222/509 |
| 4,986,448 | 1/1991 | Takahashi et al. | 222/509 |
| 5,377,878 | 1/1995 | Rainey et al. | 222/146.6 |
| 5,444,992 | 8/1995 | Bell | 222/146.6 |

*Primary Examiner*—Joseph A. Kaufman
*Attorney, Agent, or Firm*—Young & Thompson

[57] ABSTRACT

A refrigerating cabinet for the distribution of liquid foodstuffs, such as spring water, is provided with an insulated housing (1) for reception of a receptacle (2) of such liquid foodstuff. The receptacle (2) has a valve (3) provided with a closure in the form of a piston that is pulled to open it. The cabinet has a base (4) enclosing a refrigeration group (5) and supporting the insulated housing (1), and a front door (6) closing the housing (1). A device (7) distributes the liquid, this device having a direct actuating device (9) for the valve (3) of the receptacle (2).

13 Claims, 3 Drawing Sheets

REFRIGERATED CABINET FOR DISPENSING LIQUID FOODSTUFFS

FIELD OF THE INVENTION

This application corresponds to French application 96 02302 of Feb. 21, 1996, the disclosure of which is incorporated herein by reference.

The present invention relates to the field of the distribution of liquid foodstuffs, particularly water, from containers disposed in refrigerated cabinets provided with a dispenser or coacting with refrigeration and dispensing means, and has for its object a refrigerating cabinet for the distribution of liquid foodstuffs contained in small receptacles, particularly for the distribution of spring water.

BACKGROUND OF THE INVENTION

At present, the distribution of spring water at workplaces and/or in public places is generally effected by means of devices for receiving receptacles containing said water and for cooling and dispensing the latter.

Such devices, ordinarily called water fountains, are provided with a gravity feed opening by means of a reusable demijohn, valved dispensing means actuable by means of a glass, a glass or the like and cooling means for the water before distribution, filtered air admission means being provided moreover for compensating the withdrawal of water from the demijohn.

These known devices permit satisfying the usual requirements of consumers. However, the demijohns, which are of rigid transparent synthetic material, rapidly undergo a process of degradation of their appearance by scratches and the like, which has an undesirable effect on consumers. Moreover, because of the mounting of the demijohn on the dispensing device and the progressive introduction of air into the latter, the quality of the delivered water degrades as a result by photosynthesis and oxidation, particularly in the case of relatively low consumption rates.

Moreover, the dispensing and cooling requires the provision of intermediate means which must be regularly used so as to guarantee the optimum quality of the beverage, by prevention of any risk of development of pathological organisms.

It is also known to carry out dispensing and sale of liquid foodstuffs by means of small rigid, semirigid or flexible receptacles, such as those in synthetic material, these receptacles being provided with dispensing and/or emptying valves fixed on their stopper. Such receptacles may be suitable for the dispensing of cooled beverages, particularly water, by arrangement in refrigerating cabinets adapted for this purpose and provided with one or several dispensing valves connected to the valves of these receptacles by means of one or several connection devices, these distribution valves being adapted to be actuated directly by means of a glass or similar container.

Upon connection, the valve fixed on the emptying connection is brought into open position and then all the dispensing actions are carried out by means of the distributing valve connected to the connection device. Such an installation can also be suitable for the usual uses, but there remains a problem of use of an additional intermediate means and the maintenance of complete sanitary conditions of these means.

Moreover, there is known more particularly from EP-A-0 432 070, a valve constituted by a body for mounting in the outlet of a receptacle and by a piston for freeing the liquid, loaded by a spring and guided in the body, the piston acting on a resilient sealing membrane secured to the body. For this manipulation, the piston is provided at its upper portion with appendages extending outside the valve through the openings of this latter and adapted to permit pulling on the piston, so as to free the dispensing opening.

Such valves also permit correct distribution of the liquid in coaction with a corresponding connection device, such as described in French application No. 95 14814, and a distribution valve. However, the drawbacks inherent to the use of the supplemental devices remain.

OBJECT OF THE INVENTION

The present invention has for its object to overcome these drawbacks and to provide a refrigerating cabinet for distribution of liquid foodstuffs contained in small receptacles comprising a valve of the pulled piston type according to EP-A-0 432 070, in particular for the dispensing of spring water, permitting directly distributing the liquid, without interposition of added connection means.

SUMMARY OF THE INVENTION

According to the invention, the cooling cabinet for distribution of liquid foodstuffs, is essentially constituted by an insulated housing for reception of at least a small receptacle of liquid foodstuff comprising a valve of the pulled piston type, by a base enclosing a refrigeration group and supporting the insulated housing by a door for closing the front face of the housing comprising at least a liquid dispensing device, is characterized in that the liquid dispensing device comprises at least one direct actuating means for the valve of the small receptacle of liquid foodstuff.

BRIEF DESCRIPTION OF THE DRAWINGS

The invention will be better understood from the following description, which relates to a preferred embodiment, given by way of non-limiting example, and explained with reference to the accompanying schematic drawings, in which.

DETAILED DESCRIPTION OF THE INVENTION

Figure 2:
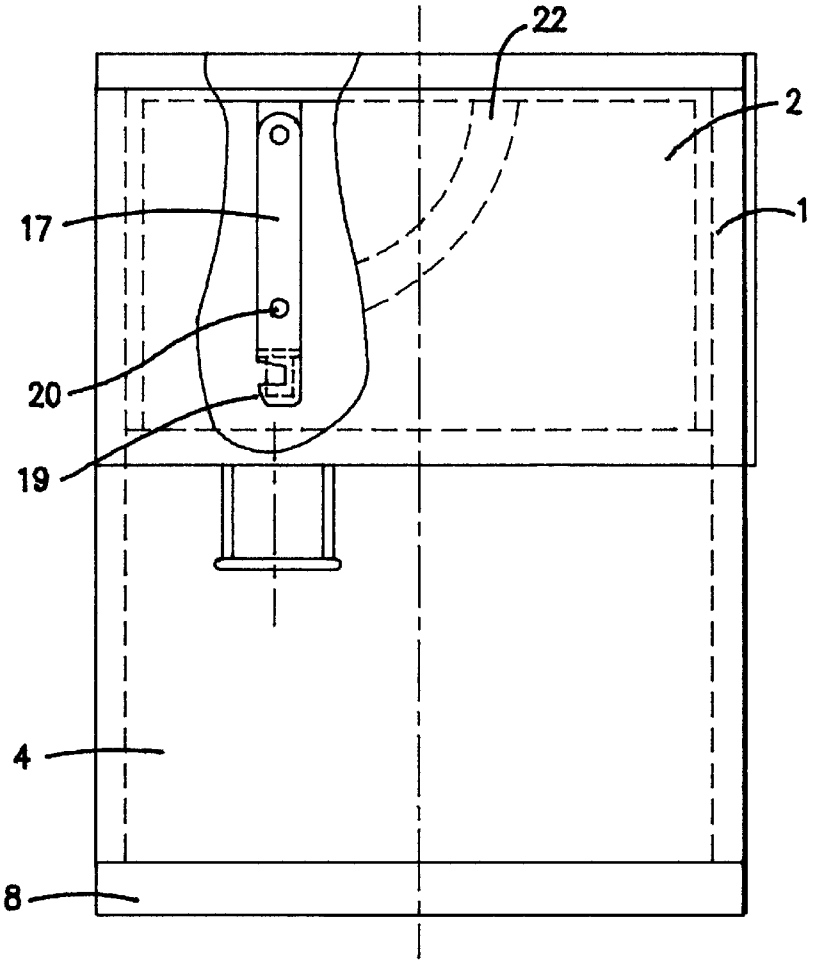
FIG. 2 is a front elevational view, partially cut away, of the cabinet according to FIG. 1.
Figure 1:
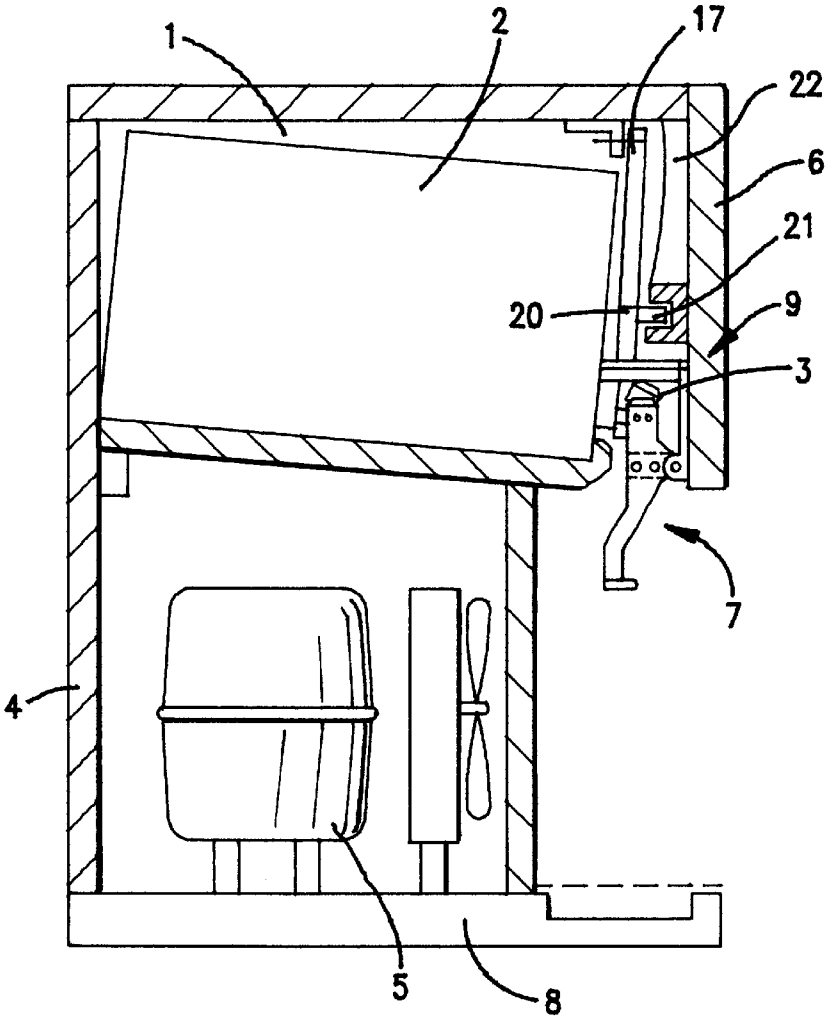
FIG. 1 is a side elevation and cross-sectional view of the cooling cabinet according to the invention.

FIG. 1 of the accompanying drawings show a refrigerating cabinet for this dispensing of liquid foodstuffs, which is essentially constituted by an insulated housing 1 for the reception of at least one small receptacle 2 of liquid foodstuff comprising a valve 3 of the pulled piston type, by a base 4 enclosing a refrigeration group 5 and supporting the insulated housing 1 and by a door 6 for closing the front face of the housing 1 comprising at least one liquid dispensing device 7. In a known manner, the base 4 comprises moreover a liquid catchment 8 extending from its forward portion below the liquid dispensing device 7.

According to the invention, the liquid dispensing device 7 comprises at least one direct actuating means 9 for the valve 3 of the small liquid foodstuff receptacle 2.

Figure 3:
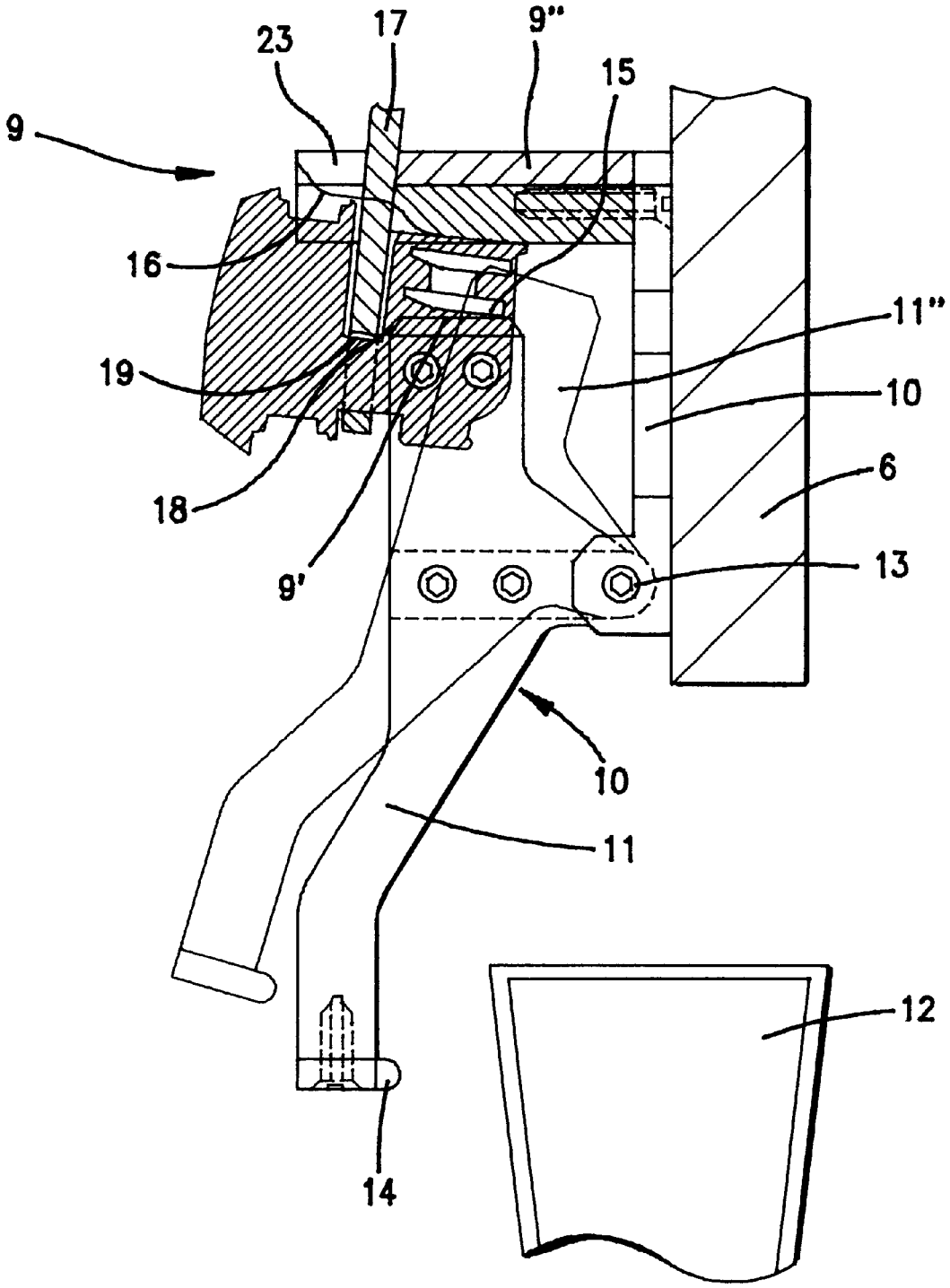
FIG. 3 is a view on a larger scale, in side elevation and in cross section, of the liquid dispensing device.

To this end, the liquid dispensing device 7 is essentially constituted, as shown more particularly in FIG. 3 of the accompanying drawings, by a support 10 for securement on the internal surface of the door 6 for closing the front surface of the housing 1 and by a control lever 11 for the direct actuating means 9 of the valve 3 of the small receptacle of liquid foodstuff 2, by means of a goblet 12, a glass or the like, this lever 11 being articulated on the support 10, near the lower edge of the closure door 6 of the front face of the housing 1 about an axle 13 and being provided with an external arm 11" having a handle 14 for bearing on the edge of said goblet 12.

The direct actuating means 9 of the valve 3 of the small receptacle of liquid foodstuff 2 is constituted by a portion 9' for pressing below the appendages 15 for manipulating the piston of the valve 3 and by a portion 9" for bearing on the body of the valve 3. The portion 9' is preferably movable and secured to an internal arm 19 of the lever 11 and in the form of an open stirrup, whose legs extend on opposite sides of the valve body 3, below the appendages 5 for manipulating the piston of said valve 3.

The portion 9" that bears on the body of the valve 3 is fixed and is in the form of a horizontal plate secured to the upper end of the support 10. This portion 9" preferably has, on its lower surface bearing on the valve body 3, a sloped inlet 16. Thus, the correct positioning of the portion 9" on the body of the valve 3 is favored. As a result, upon replacement of one receptacle 2 by another, the direct actuating means 9 of the valve 3 is automatically located on this latter and is ready to actuate said valve 3.

The valve 3 being mounted on the receptacle 2 for liquid foodstuff with the possibility of rotation in the outlet of this latter, it is necessary to ensure the correct positioning of said valve 3 before closing the door 6, following filling of the insulated housing 1 for receiving the small receptacle 2 of liquid foodstuff, so as to avoid any risk of damage to the valve 3 by the actuating means 9.

To this end, according to another characteristic of the invention, the insulated housing 1 is provided with a device 17 for verification of the positioning and connection in position of the valve 3, mounted freely pivotally in or on the insulated housing 1 and coacting with a reference surface 18 of the body of said valve 3.

According to one characteristic of the invention, the device 17 for verification of the positioning and connection in position of the valve 3 is preferably in the form of a latch mounted pivotally at one end in the upper portion of the insulated housing 1 and having at its free end a cutout in the form of a hook 19, whose cross section corresponds to that of the valve body 3 at the level of the reference surface 18 of this latter. Thus, after positioning a new receptacle 2 of liquid foodstuff, it is possible to verify instantaneously whether the valve 3 is correctly positioned or to correctly position said valve 3 by simple lowering of the device 17 into its service position, in which its cutout in the form of a hook 19 coacts with the corresponding portion of the valve body 3.

Thus, in the case in which the valve 3 is not correctly oriented, the device 17 cannot coact via its cutout 19 with the reference surface 19 of the valve body 3. It is then necessary to turn the valve in the outlet of the receptacle 2 until the cutout 19 coacts with the surface 18 and abuts against the body of the valve 3 at its base.

To increase the certainty of positioning the valve 3 and to ensure with certainty that the device 17 is perfectly engaged with the corresponding portion of said valve 3, said device 17 is provided with indexing means 20, projecting in the direction of the door 6 of the insulated housing 1 and coacting with a concavity 21 of an element 22 projecting on the internal surface of said door 6, this element 22 extending over all the path of the means 20 and of the device 17 and the concavity 21 being provided at the level of the locking position of the valve 3 by said device 17. Thus, because the device 17 and the means 20 are always opposite the element 22 of the door 6, this latter can be closed only in the locking position of the valve 3, in which the means 20 can penetrate the concavity 21. As a result, an operator will immediately detect any mispositioning of the valve 3 and can correct it before closing the door 6.

According to a modified embodiment of the invention, and as shown more particularly in FIG. 3 of the accompanying drawings, the indexing means could also be constituted by a cutout 23, provided in the free end of the portion 9" bearing on the valve body 3 of the direct actuating means of said valve 3 and surrounding the device 17 in its locking position of the valve 3. Thus, only the correct positioning of the device 17 on the valve body 3, and in particular on its reference surface 18, will permit closing the door 6. Thus, if the device 17 is not perfectly engaged with said valve body 3, the edge of the cutout 23 permits the closing of the door 6 by abutting against said device and only a correct positioning of this latter will permit its reception in the cutout 23.

After emplacing a receptacle 2 in its service position and locking the valve 3 by means of a device 17, whose position is controlled by means of the indexing means 20 or the cutout 23 during closure of the door 6, the direct actuating means 9 of the valve 3 bears on the one hand with its upper fixed portion 9" against the body of said valve 3 and, on the other hand, by its movable roller portion 9', in the form of an open stirrup secured to the internal arm 16 of the lever 11, below the appendages 15 for manipulating the piston of said valve 3.

Upon pressure on the lever 11 by means of a goblet 12, a glass or the like, which bears by its edge against the handle 14 of the external arm 11" of the lever 11, the legs of the open stirrup forming the lower movable portion 9' of the direct actuating means 9 of the valve 3 press the appendages 15 for manipulating the piston of said valve 3 into the position of opening this latter by the piston, thereby permitting distribution of the liquid contained in the receptacle 2.

Figure 4:
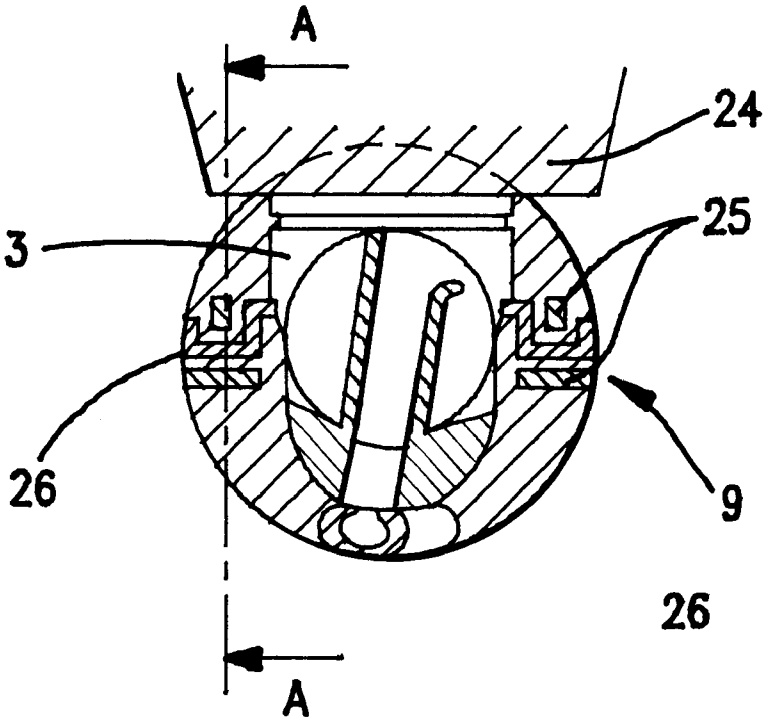
FIG. 4 is a front elevation and cross section of a modified embodiment of the direct actuating means of the valve.
Figure 5:
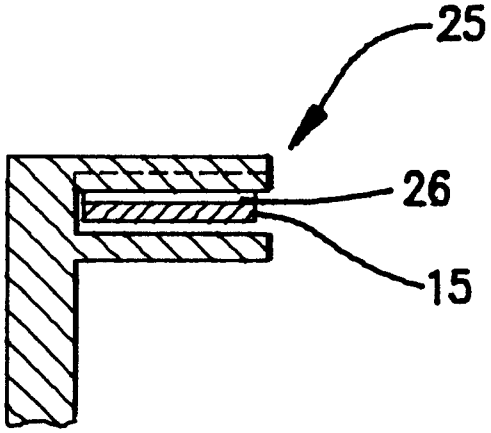
FIG. 5 is a fragmentary cross-sectional view on the line A—A of FIG. 4.

FIGS. 4 and 5 of the accompanying drawings show a modified embodiment of the invention, in which the direct actuating means 9 of the valve 3 is constituted by a fixed upper portion 24 bearing on the body of the valve 3 and by a lower movable portion 25 containing the appendages 15 for directly manipulating the piston of said valve 3. This movable lower portion 25 is preferably in the form of two identical parallel forks, provided at the upper ends of the control lever 11 of the direct actuating means 9 of the valve 3 and whose teeth extend on opposite sides of the appendages 15.

According to one characteristic of the invention, and as shown more particularly in FIG. 4, the upper teeth of the fork constituting the movable lower portion 25 coact shapewise with the upper surface of the appendages 15 and have a transverse cross section corresponding to that of the throats 26, grooves or ribs provided on said upper surface of said appendages 15. Such an embodiment permits limiting the operation of the refrigerating cabinet according to the invention to specific receptacles provided with special valves. This is particularly interesting in the case in which the supply and distribution of beverages are ensured by the distribution companies connected by contract, so as to guarantee fulfillment of the contract. Thus, in such a case, the distributor generally supplies the refrigerating cabinet and must be able to ensure, for example by the monopoly on the type of control appendages of the piston of the valve, that only the receptacles which it supplies, provided with specific valves, are usable with said cabinet, thereby preventing fraudulent operation, all the other receptacles being unable to coact, by their valve, with the means 9.

Thanks to the invention, it is possible to provide a refrigerating cabinet for the distribution of liquid foodstuffs, of simple construction permitting the use of receptacles provided with valves of the pulled piston type, whose actuation is effected directly by the device for dispensing liquid, without requiring intermediate connection means.

Of course, the invention is not limited to the embodiment described and shown in the accompanying drawings. Modifications remain possible, particularly as to the construction of the various elements or by substitution of technical equivalents, without thereby departing from the scope of protection of the invention.

What is claimed is:

1. In a refrigerating cabinet for dispensing liquid foodstuffs, comprising an insulated housing (1) for receiving a receptacle (2) of liquid foodstuff, the receptacle having a valve (3) having a pulled piston, the cabinet comprising a base (4) enclosing refrigeration means (5) and supporting the insulated housing (1) and a door (6) for closing the front face of the housing (1), the cabinet having a device (7) for dispensing liquid, the base (4) having in its forward portion a liquid catchment (8) below the liquid dispensing device (7); the improvement in which the liquid dispensing device (7) comprises means (9) for directly actuating the valve (3) of the receptacle (2).

2. Refrigerating cabinet according to claim 1, wherein the liquid dispensing device (7) comprises a support (10) for securement on an internal surface of the door (6) which closes the front face of the housing (1) and a control lever (11) for the direct actuating means (9) of the valve (3), said lever being articulated on the support (10) adjacent a lower edge of the door (6) about an axle (13) and being provided with an external arm (11") having a handle (14) for actuation by engagement with a receptacle (12) for a liquid to be dispensed.

3. Refrigerating cabinet according to claim 1, wherein the direct actuating means (9) of the valve (3) comprises a portion (9') that bears below appendages (15) for actuating the piston of the valve (3) and a portion (9") that bears on the body of the valve (3).

4. Refrigerating cabinet according to claim 3, wherein the portion (9') that bears below the appendages (15) for actuating the piston of the valve (3) is movable and secured to an internal arm (16) of a lever (11) which controls the direct actuating means (9) of the valve (3), said portion (9') being in the form of an open stirrup having legs extending on opposite sides of the valve body (3), below said appendages (15).

5. Refrigerating cabinet according to claim 3, wherein said portion (9") bearing on the body of the valve (3) is fixed and is in the form of a horizontal plate secured to the upper end of a support (10).

6. Refrigerating cabinet according to claim 3, wherein said portion (9") that bears on the body of the valve (3) has on its lower surface that bears on the body of the valve (3) a sloped inlet (16).

7. Refrigerating cabinet according to claim 1, wherein the insulated housing (1) is provided with a device (17) for verification of the positioning and connection of the valve (3), mounted freely pivotably relative to the insulated housing (1) and coacting with a reference surface (18) of the body of said valve (3).

8. Refrigerating cabinet according to claim 7, wherein said device (17) for verification of the positioning and connection of the valve (3) is in the form of a latch pivotably mounted at one end in the upper portion of the insulated housing (1) and having at a free end a cutout in the form of a hook (19) whose cross section corresponds to that of the body of the valve (3) at the level of said reference surface (18).

9. Refrigerating cabinet according to claim 7, wherein said device (17) for verification of the positioning and connection of the valve (3) has indexing means (20) projecting in the direction of the door (6) of the insulated housing (1) and coacting with a concavity (21) of an element (22) projecting on the internal surface of said door (6), said element (22) extending over all the path of the indexing means (20) and of the device (17) and the concavity (21) being provided at the level of the locking position of the valve (3) by said device (17).

10. Refrigerating cabinet according to claim 7, further comprising indexing means in the form of a cutout (23) provided in a free end of said portion (9") bearing on the body of the valve (3) of the direct actuating means (9) of the valve (3) and surrounding the verification device (17) in its locking position of the valve (3).

11. Refrigerating cabinet according to claim 1, wherein said direct actuating means (9) of the valve (3) comprises a fixed upper portion (24) bearing on the body of the valve (3) and a lower movable portion (25) enclosing manipulating appendages (15) of the piston of said valve (3).

12. Refrigerating cabinet according to claim 11, wherein the movable lower portion (25) is in the form of two identical parallel forks, provided at upper ends of a control lever (11) of the direct actuating means (9) of the valve (3) and having teeth extending on opposite sides of said appendages (15).

13. Refrigerating cabinet according to claim 12, wherein upper teeth on said forks constituting the movable lower portion (25) coact shape-matingly with the upper surface of the said appendages (15) and have a transverse cross section corresponding to that of structure provided on said upper surface of said appendages (15).

* * * * *